US012654827B2

(12) United States Patent
Semien

(10) Patent No.: US 12,654,827 B2
(45) Date of Patent: Jun. 16, 2026

(54) BUOY SNORKEL

(71) Applicant: Erwin Semien, Liberty, TX (US)

(72) Inventor: Erwin Semien, Liberty, TX (US)

( * ) Notice: Subject to any disclaimer, the term of this patent is extended or adjusted under 35 U.S.C. 154(b) by 775 days.

(21) Appl. No.: 17/902,532

(22) Filed: Sep. 2, 2022

(65) Prior Publication Data

US 2023/0062895 A1 Mar. 2, 2023

Related U.S. Application Data

(60) Provisional application No. 63/186,145, filed on Sep. 2, 2021.

(51) Int. Cl.
*B63C 11/20* (2006.01)

(52) U.S. Cl.
CPC ..... *B63C 11/207* (2013.01)

(58) Field of Classification Search
CPC ..... B63C 11/207; B63C 11/00; B63C 11/02; B63C 11/12; B63C 11/16; B63C 11/14; B63C 11/18; B63C 11/20; B63C 11/205; B63C 2011/165
USPC ..... 128/201.11
See application file for complete search history.

(56) References Cited

U.S. PATENT DOCUMENTS 1,755,939 A * 4/1930 Uhlig ..... B63C 11/207 441/80
3,370,586 A * 2/1968 Aragona ..... B63C 11/207 128/201.11
4,583,536 A * 4/1986 Jan ..... B63C 11/207 137/202
5,351,681 A * 10/1994 Hudson ..... B63C 11/207 128/201.27
5,622,165 A * 4/1997 Huang ..... B63C 11/207 128/201.27
6,408,844 B1 * 6/2002 Lee ..... B63C 11/207 128/201.27
2018/0327064 A1 * 11/2018 Scheepers ..... B63C 11/207

FOREIGN PATENT DOCUMENTS

GB 2187103 A * 9/1987 ..... B63C 11/186
KR 20200016531 A * 2/2020

* cited by examiner

*Primary Examiner* — Colin W Stuart
(74) *Attorney, Agent, or Firm* — Kirby Drake

(57) ABSTRACT

A detachable buoyant cross or clover design offers greater buoyancy and stability. The buoy snorkel may include threaded top and bottom fittings that may allow a flexible hose to be attached or detached through use of a quick connect mechanism, such as one or more cam locks. The buoy snorkel may be a single unit that provides for a flexible hose or breathing tube to be attached or detached on the top and bottom. The flexible hose may have buoyant support to keep the flexible hose or breathing tube afloat. The buoy snorkel may have a clover or cross-type design that may provide greater buoyancy and stability in and on the water.

6 Claims, 5 Drawing Sheets

BUOY SNORKEL

CROSS REFERENCE TO RELATED APPLICATION

This application claims the benefit under 35 U.S.C. § 119(e) of U.S. Provisional Patent Application Ser. No. 63/186,145 filed on Sep. 2, 2021, which is incorporated by reference in its entirety.

FIELD OF THE DISCLOSURE

The present disclosure generally relates to water sports, and more particularly to snorkeling using a detachable buoy-like floatation device.

BACKGROUND

Snorkel floatation devices have typically involved using a weight on the end to work independently, and a rigid, non-detachable breathing tube is typically used. There have been buoyancy and stability issues with these types of configurations.

SUMMARY

Embodiments of the present disclosure may provide a detachable buoy snorkel having a cross or clover design that may offer greater buoyancy and stability. The buoy snorkel may include threaded top and bottom fittings that may allow a flexible hose to be attached or detached through use of a quick connect mechanism, such as one or more cam locks. The buoy snorkel may be a single unit that may provide for a flexible hose or breathing tube to be attached or detached on the top and/or bottom. The flexible hose may have buoyant support to keep the flexible hose or breathing tube afloat. The buoy snorkel may have a clover or cross-type design that may provide greater buoyancy and stability in and on the water.

Embodiments of the present disclosure may provide a buoy snorkel comprising: a hollow body having threaded top and bottom fittings; and a flexible hose attached to the hollow body through the threaded top and bottom fittings, wherein the hollow body may provide buoyant support to the flexible hose. The buoy snorkel may have a cross-type or clover-type design. The buoy snorkel may include a quick connect mechanism provided on each of the threaded top and bottom fittings to attach the flexible hose. The quick connect mechanism may be a cam lock.

Other embodiments of the present disclosure may provide a buoy snorkel comprising: a hollow body having top and bottom quick connect mechanisms; and a flexible hose attached to the hollow body through the top and bottom quick connect mechanism, wherein the hollow body may provide buoyant support for the flexible hose, keeping the flexible hose above the surface of water when in use. The quick connect mechanisms may be one or more cam locks. The buoy snorkel may have a cross-type or clover-type design. The hollow body may be formed of foam. The flexible hose may be formed of polyvinyl chloride (PVC) or plastic. A bottom portion of the flexible hose may connect with a mouthpiece. A top portion and a bottom portion of the flexible hose may each include a disc to receive the quick connect mechanisms. The top portion and the bottom portion of the flexible hose may each have a threaded fitting.

Other technical features may be readily apparent to one skilled in the art from the following figures, descriptions and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Embodiments of the present disclosure may provide a buoy snorkel that may float on or above water. The buoy snorkel may include a hollow interior and may have a hollow tube or pipe, such as a hose or breathing tube, that may pass through the floatation device. The top and bottom of the buoy snorkel may be threaded or fastened using a quick connect or cam lock mechanism to allow the floatation device to be attached and detached to or from a snorkel or its equivalent.

Embodiments of the present disclosure may provide a buoy snorkel having a clover or cross-type design combined with one or more detachable fittings to attach to or connect with a flexible hose or breathing tube. The detachable fittings may be quick connect fittings, such as cam locks, in an embodiment of the present disclosure. The buoy snorkel may allow greater flexibility underwater as well as use of a longer line or hose. In an embodiment of the present disclosure, a ten-foot hose may allow more depth for the snorkeler, and the design of the buoy snorkel may keep the flexible hose or breathing tube above the surface of the water when in use. The buoy snorkel according to embodiments of the present disclosure also may be used to play underwater games, such as water polo or diving for horseshoes, with reduced concern of water getting into the flexible hose or breathing tube.

Figure 1:
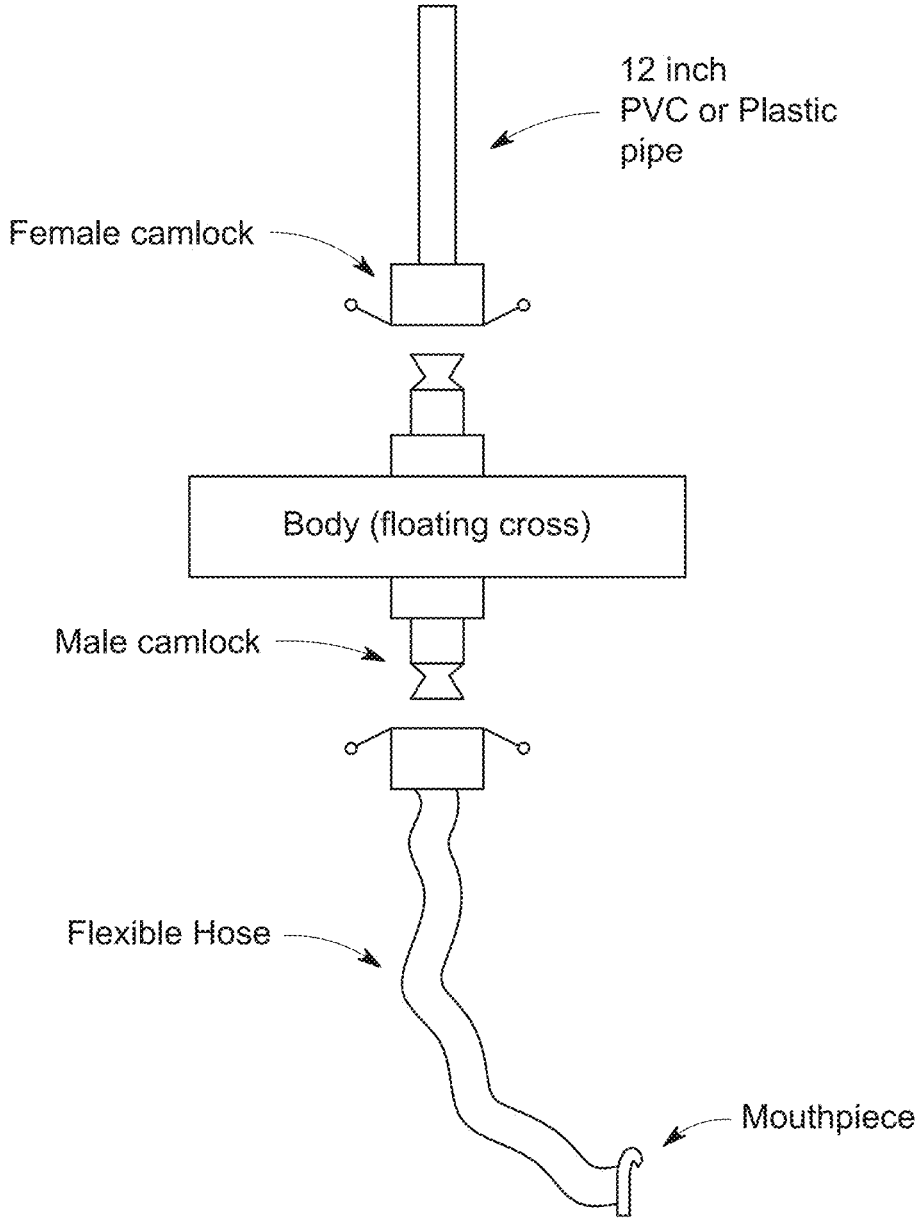
FIG. 1 depicts a buoy snorkel according to an embodiment of the present disclosure.

FIG. 1 depicts a buoy snorkel according to an embodiment of the present disclosure. The body may have a cross-like design as depicted herein having male cam locks on a top portion and a bottom portion of the body. The top male cam lock may attach or connect to a female cam lock that may be associated with a pipe, such as a 12-inch polyvinyl chloride (PVC) or plastic pipe as depicted in FIG. 1. While the pipe is described as being formed of PVC or plastic, it should be appreciated that there may be other materials used to form the pipe without departing from the present disclosure. The bottom male cam lock may attach or connect to a female cam lock that may be associated with a flexible hose that may connect with a mouthpiece, such as may be used for snorkeling or other underwater activities.

Figure 2:
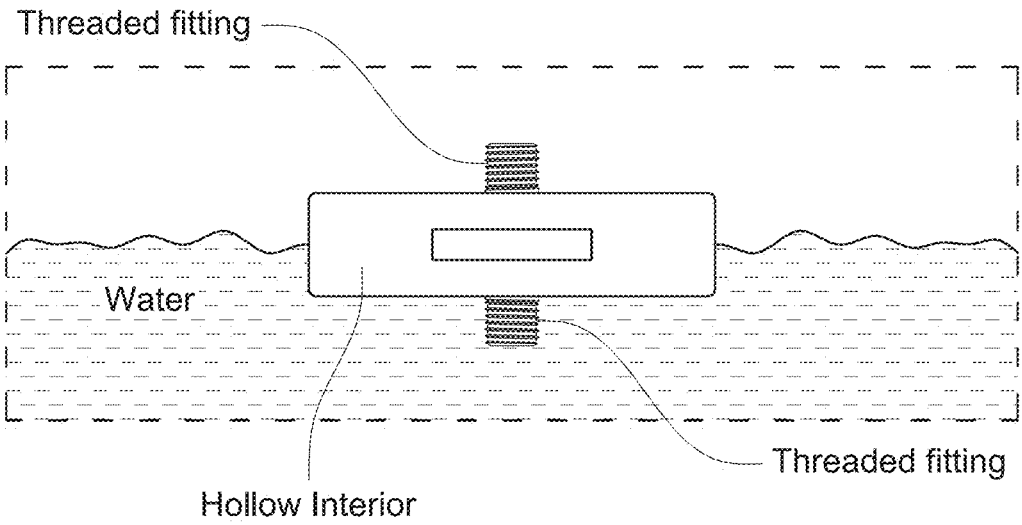
FIG. 2 depicts a side view of a buoy snorkel according to an embodiment of the present disclosure.

FIG. 2 depicts a side view of a buoy snorkel according to an embodiment of the present disclosure. As depicted herein, the body may have a hollow interior. A threaded fitting may be provided on the top portion and the bottom portion of the body to be associated with a pipe on the top and a flexible hose that may connect with a mouthpiece on the bottom.

Figure 3:
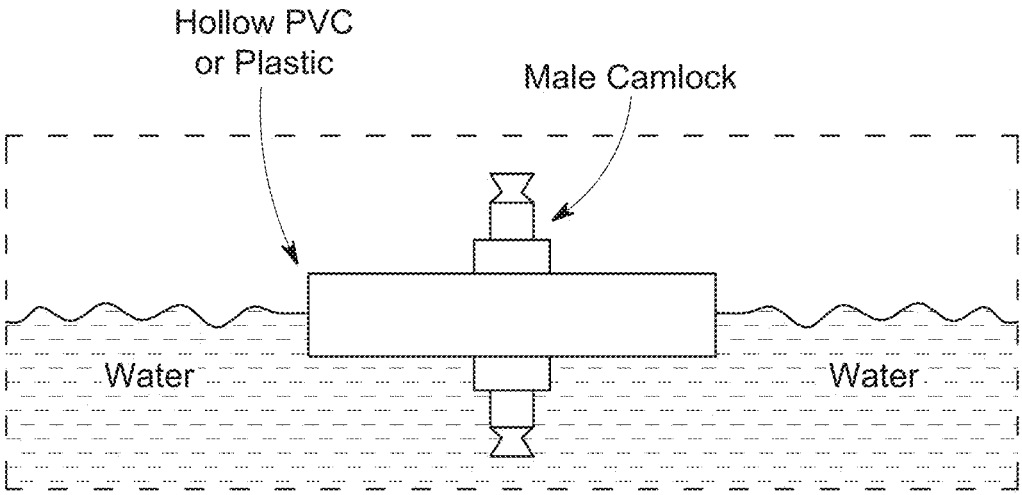
FIG. 3 depicts another side view of a buoy snorkel according to an embodiment of the present disclosure.

FIG. 3 depicts another side view of a buoy snorkel according to an embodiment of the present disclosure. As depicted herein, the body again may have a hollow interior and may be formed of PVC or plastic in an embodiment of the present disclosure. However, other materials may be used to form the pipe without departing from the present disclosure. In this embodiment, male cam locks may be provided both on a top portion and a bottom portion of the body.

Figure 4A:
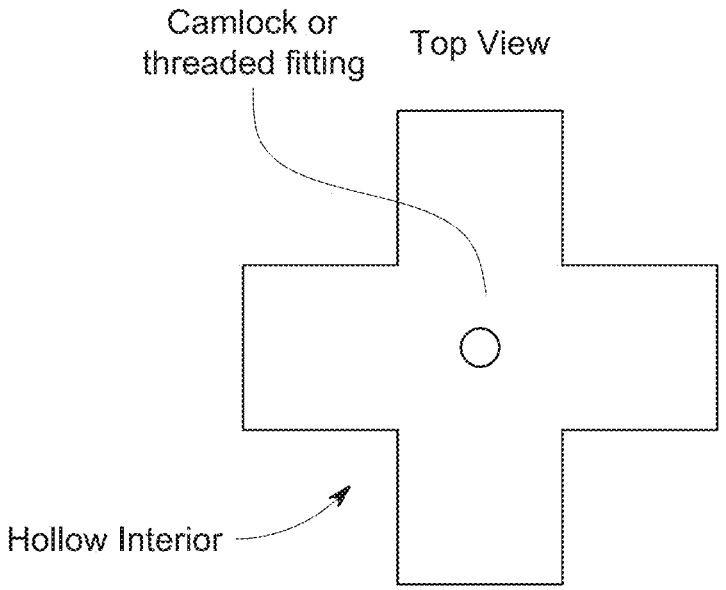
FIG. 4A depicts a top view of a body of a buoy snorkel having a cross-type design according to an embodiment of the present disclosure.

FIG. 4A depicts a top view of a body of a buoy snorkel having a cross-type design according to an embodiment of the present disclosure. The body may have a hollow chamber. As depicted herein, a male cam lock or a threaded fitting may be provided on a top portion of the body. This male cam lock or a threaded fitting may attach to or connect with a female cam lock or other threaded fitting provided on a PVC or plastic pipe in an embodiment of the present disclosure.

Figure 4B:
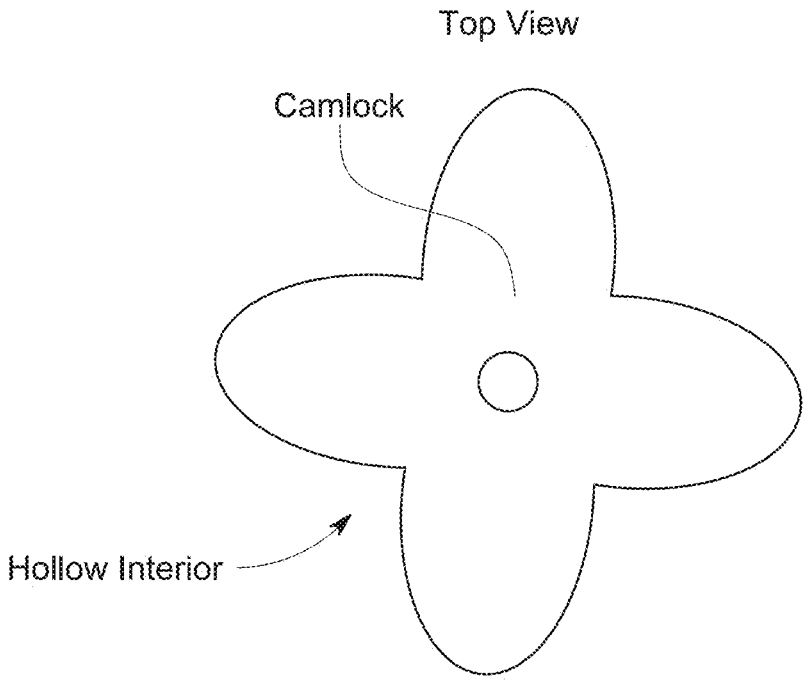
FIG. 4B depicts a top view of a body of a buoy snorkel having a clover-type design according to an embodiment of the present disclosure.

FIG. 4B depicts a top view of a body of a buoy snorkel having a clover-type design according to an embodiment of the present disclosure. As with FIG. 4A, the body may have a hollow chamber, and a male cam lock or a threaded fitting may be provided on a top portion of the body. This male cam lock or a threaded fitting may attach to or connect with a female cam lock or other threaded fitting provided on a PVC or plastic pipe in an embodiment of the present disclosure.

Figure 5A:
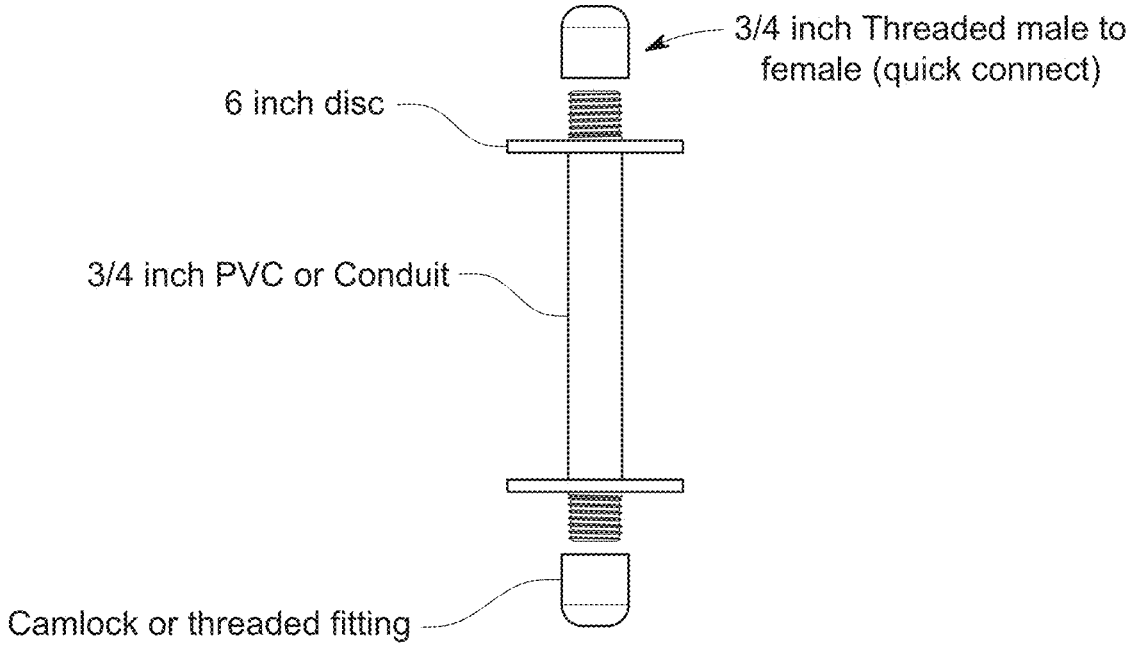
FIG. 5A depicts an exploded view of a buoy snorkel according to an embodiment of the present disclosure.

FIG. 5A depicts an exploded view of a buoy snorkel according to an embodiment of the present disclosure. As depicted herein, a PVC or plastic pipe may include a disc on a top end and a bottom end with a threaded fitting on each end. The PVC or plastic pipe may be ¾-inch in size in an embodiment of the present disclosure; however, pipes of other sizes (larger or smaller in diameter) and/or formed of other materials may be used without departing from the present disclosure. Discs may be 6 inches in diameter in an embodiment of the present disclosure; however, discs may be of other sizes without departing from the present disclosure. For example, a larger disc may be used if the pipe is of a larger size. The threaded fittings may be ¾-inch in size in an embodiment of the present disclosure; however, again, the fittings may be larger or smaller without departing from the present disclosure. In an embodiment of the present disclosure, a quick connect, such as a cam lock, may be provided on each end.

Figure 5B:
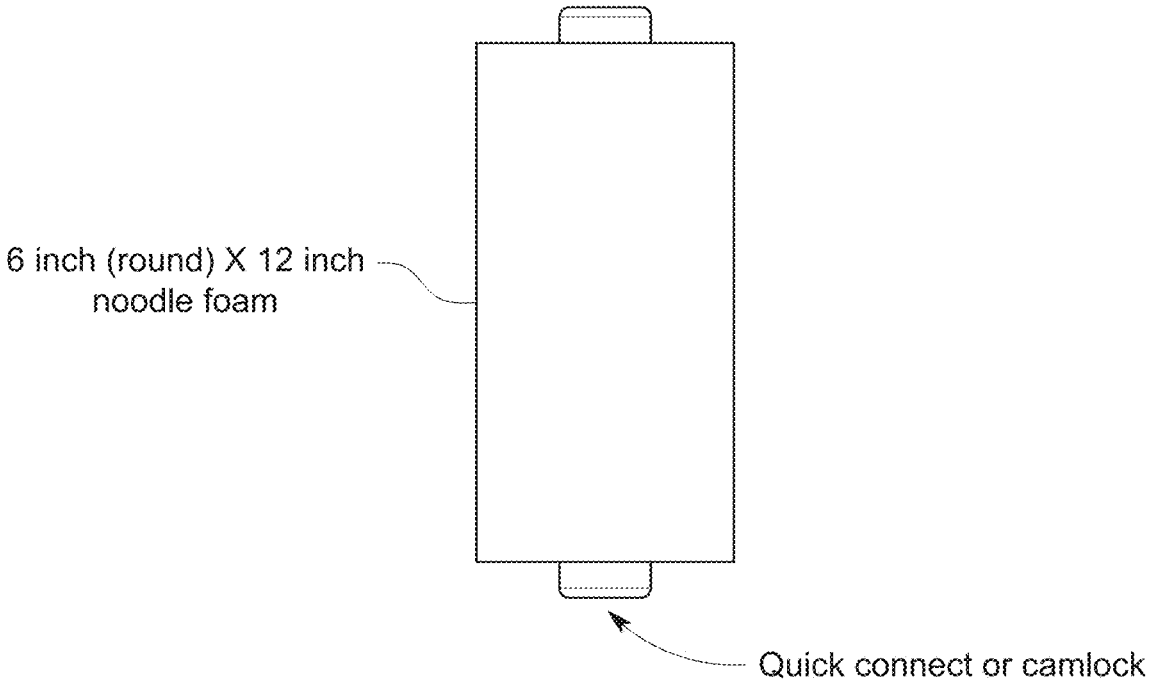
FIG. 5B depicts a body of a buoy snorkel according to an embodiment of the present disclosure.

FIG. 5B depicts a body of a buoy snorkel according to an embodiment of the present disclosure. As depicted herein, the body may be 6×12 inches in size an embodiment of the present disclosure and may be formed of a material such as may be used for a pool noodle, such as polyethylene foam. However, the body may have different sizes and may be formed of other materials without departing from the present disclosure. The body may be hollow to receive a pipe or hose.

Figure 5C:
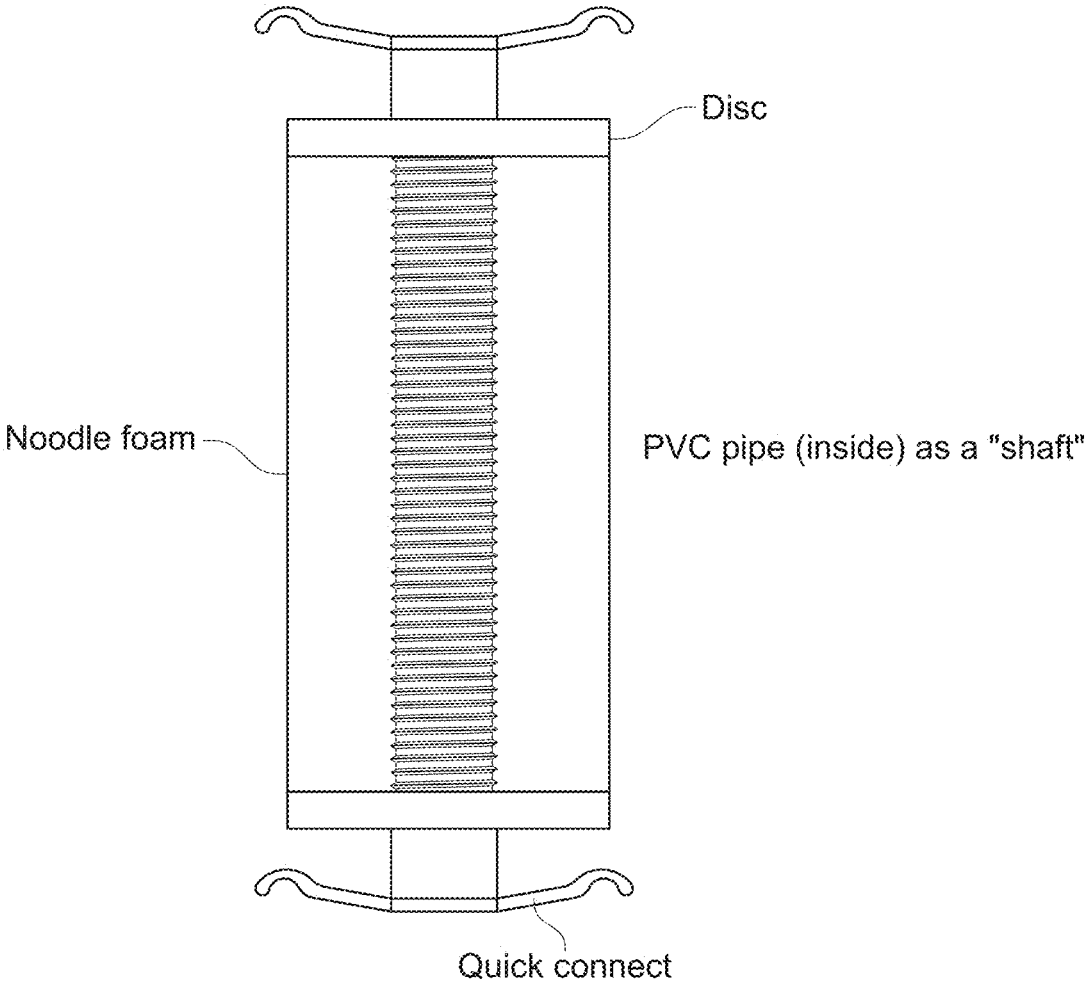
FIG. 5C depicts an assembled view of a buoy snorkel according to an embodiment of the present disclosure.

FIG. 5C depicts an assembled view of a buoy snorkel according to an embodiment of the present disclosure. When assembled, the body (such as that depicted in FIG. 5B) may be formed around the pipe (such as that depicted in FIG. 5A). Accordingly, when assembled, the pipe may be inside the body, acting as a shaft.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A buoy snorkel comprising:

a plastic pipe including a top planar disc provided to a top end of the plastic pipe and a bottom planar disc provided to a bottom end of the plastic pipe with a quick connect mechanism provided to each planar disc;

a cylindrical hollow body which surrounds the plastic pipe and provides buoyant support, wherein the cylindrical hollow body has an overall width that is the same as an overall width of the top planar disc and the same as an overall width of the bottom planar disc;

an additional plastic pipe including a fitting configured to attach to the quick connect mechanism of the top planar disc; and a flexible breathing hose including a fitting configured to attach to the quick connect mechanism of the bottom planar disc, wherein the cylindrical hollow body provides buoyant support to keep the additional plastic pipe and the top quick connect mechanism above a water line and the flexible breathing hose and the bottom quick connect mechanism below the water line, wherein fluid communication is provided from the additional plastic pipe to the plastic pipe to the flexible breathing hose.

2. The buoy snorkel of claim 1, wherein the cylindrical hollow body is formed of foam.

3. The buoy snorkel of claim 1, wherein the top and bottom quick connect mechanisms are cam locks.

4. The buoy snorkel of claim 1, wherein the top and bottom quick connect mechanisms are threaded fittings.

5. The buoy snorkel of claim 1, wherein the flexible breathing hose is formed of polyvinyl chloride (PVC) or plastic.

6. The buoy snorkel of claim 1, wherein a bottom portion of the flexible breathing hose connects with a mouthpiece.

* * * * *